US010668766B2

(12) United States Patent
Rolion et al.

(10) Patent No.: US 10,668,766 B2
(45) Date of Patent: Jun. 2, 2020

(54) MECHANICAL PENCIL WITH A SIDE BUTTON AND AN ERASER DISPENSER AND A METHOD OF ASSEMBLY

(71) Applicant: SOCIETE BIC, Clichy (FR)

(72) Inventors: Franck Rolion, Asnieres sur Oise (FR); Ludovic Fagu, Noisy le Sec (FR)

(73) Assignee: SOCIETE BIC, Clichy (FR)

( * ) Notice: Subject to any disclaimer, the term of this patent is extended or adjusted under 35 U.S.C. 154(b) by 8 days.

(21) Appl. No.: 16/076,647

(22) PCT Filed: Feb. 8, 2017

(86) PCT No.: PCT/FR2017/050282
§ 371 (c)(1),
(2) Date: Aug. 8, 2018

(87) PCT Pub. No.: WO2017/137697
PCT Pub. Date: Aug. 17, 2017

(65) Prior Publication Data

US 2019/0047320 A1 Feb. 14, 2019

(30) Foreign Application Priority Data

Feb. 11, 2016 (FR) ..... 16 51101

(51) Int. Cl.
*B43K 21/16* (2006.01)
*B43K 29/02* (2006.01)
(Continued)

(52) U.S. Cl.
CPC ..... *B43K 21/16* (2013.01); *B43K 21/02* (2013.01); *B43K 21/027* (2013.01); *B43K 21/22* (2013.01);
(Continued)

(58) Field of Classification Search
CPC ..... B43K 21/16; B43K 29/02; B43K 19/00; B43K 21/02; B43K 210/027; B43K 21/22;
(Continued)

(56) References Cited

U.S. PATENT DOCUMENTS 4,650,359 A 3/1987 Sakaoka
5,354,141 A 10/1994 Watanabe
(Continued)

FOREIGN PATENT DOCUMENTS

CN 1126147 7/1996
CN 2298136 11/1998
(Continued)

OTHER PUBLICATIONS

International Search Report dated May 2, 2017 from corresponding International PCT Application No. PCT/FR2017/050282, 7 pages.

*Primary Examiner* — David J Walczak
(74) *Attorney, Agent, or Firm* — Ohlandt, Greeley, Ruggiero & Perle, L.L.P.

(57) ABSTRACT

A mechanical pencil includes a barrel extending in a longitudinal direction, a lead-propelling mechanism, a lead reservoir, a side button, and an eraser-propelling mechanism having a helical cam. The lead-propelling mechanism, the lead reservoir, the eraser-propelling mechanism, and the side button are at least partly housed inside the barrel. The lead-propelling mechanism, the lead reservoir, and the eraser-propelling mechanism are prevented from rotating about the longitudinal direction relative to one another and relative to the side button, and the side button is prevented from rotating about the longitudinal direction relative to the barrel.

13 Claims, 7 Drawing Sheets

(51) Int. Cl.

| | |
|---|---|
| ***B43K 21/02*** | (2006.01) |
| ***B43K 21/027*** | (2006.01) |
| ***B43K 21/24*** | (2006.01) |
| ***B43L 19/00*** | (2006.01) |
| ***B43K 21/22*** | (2006.01) |

(52) U.S. Cl.
CPC ..... *B43K 29/02* (2013.01); *B43L 19/00* (2013.01); *B43K 21/24* (2013.01)

(58) Field of Classification Search
CPC .. B43K 24/082; B43K 21/003; B43K 21/006; B43K 21/24
See application file for complete search history.

(56) References Cited

U.S. PATENT DOCUMENTS

| | | | | |
|---|---|---|---|---|
| 5,702,193 | A * | 12/1997 | Kageyama ..... | B43K 21/20 401/65 |
| 6,065,889 | A | 5/2000 | Maruyama et al. | |
| 2002/0031393 | A1 | 3/2002 | Saito | |
| 2011/0229245 | A1 | 9/2011 | Wang | |

FOREIGN PATENT DOCUMENTS

| | | |
|---|---|---|
| CN | 2820557 | 9/2006 |
| CN | 101797858 | 8/2010 |
| DE | 2654281 | 6/1978 |
| DE | 8110960 | 9/1981 |
| EP | 0311121 | 4/1989 |
| GB | 2100675 | 1/1983 |
| JP | 3-138199 | 6/1991 |
| JP | 3-264397 | 11/1991 |
| JP | 4-212000 | 8/1992 |
| JP | 5-41892 | 6/1993 |
| JP | 5-51693 | 7/1993 |
| JP | 5-88985 | 12/1993 |
| JP | 6-67093 | 3/1994 |
| JP | 6-49096 | 7/1994 |
| JP | 6-63389 | 9/1994 |
| JP | 7-21388 | 4/1995 |
| JP | 8-85292 | 4/1996 |
| JP | 9-123678 | 5/1997 |
| JP | 9-131996 | 5/1997 |
| JP | 9-234989 | 9/1997 |
| JP | 9-254585 | 9/1997 |
| JP | 10-184 | 8/1998 |
| JP | 11-78376 | 3/1999 |
| JP | 2002-11993 | 1/2002 |
| JP | 2003-118293 | 4/2003 |
| JP | 2003-182284 | 7/2003 |
| JP | 2003-220793 | 8/2003 |
| JP | 2005-48812 | 2/2005 |
| JP | 2005-67100 | 3/2005 |
| JP | 2005-131968 | 5/2005 |
| JP | 2005-186441 | 7/2005 |
| JP | 2006-103015 | 4/2006 |
| JP | 2006-110751 | 4/2006 |
| JP | 2006-142522 | 6/2006 |
| JP | 2006-212940 | 8/2006 |
| JP | 2009-269211 | 11/2009 |
| JP | 2010-94954 | 4/2010 |
| JP | 2010-94955 | 4/2010 |
| JP | 2010-94956 | 4/2010 |
| JP | 2010-94957 | 4/2010 |
| JP | 2013-252661 | 12/2013 |
| JP | 2014-69398 | 4/2014 |
| JP | 2014-233884 | 12/2014 |
| WO | 92/15462 | 9/1992 |
| WO | 96/23666 | 8/1996 |
| WO | 97-07990 | 3/1997 |
| WO | 2014/119508 | 8/2014 |

* cited by examiner

MECHANICAL PENCIL WITH A SIDE BUTTON AND AN ERASER DISPENSER AND A METHOD OF ASSEMBLY

BACKGROUND

The present disclosure relates to a laterally-activated mechanical pencil with an eraser-propelling mechanism.

The eraser-propelling mechanism makes it possible to extend or retract the eraser inside a barrel of the mechanical pencil, the barrel extending in a longitudinal direction.

To this end, the eraser-propelling mechanism generally comprises a tube carrying a helical cam and a translation guide cylinder making it possible to transform a rotation movement of the tube into a translation movement of the eraser in the longitudinal direction.

It should be understood that the guide cylinder is prevented from rotating relative to the barrel so that it is not rotated with the tube carrying the helical cam.

The guide cylinder is generally prevented from rotating either by mechanically clamping an end of the guide cylinder in the barrel and/or by cooperation between at least one groove and at least one rib located respectively at one end of the guide cylinder and on the barrel or vice versa.

Given the manufacturing tolerances on parts obtained by injection-molding plastics material for example, it may turn out to be difficult to achieve mechanical clamping and certain parts are scrapped.

In addition, it may also be difficult to carry out the dimensional controls of the rib and/or the groove in the barrel. Since the guide cylinder is generally inserted into the barrel via the end at which the groove or the rib is located, the rib or groove as the case may be of the barrel is of a dimension in the longitudinal direction that is relatively long (corresponding to the length of insertion of the guide cylinder in the barrel) and of a dimension in a circumferential direction that is relatively short.

In addition, that type of mechanical pencil is generally complicated to assembled since it is necessary to prevent certain parts from rotating about the longitudinal direction. Assembly is made even more complex by adding a side button for actuating a lead-propelling mechanism.

It is often necessary to index the parts in a circumferential or azimuth direction so as to be able to assemble all of the elements that make up the mechanical pencil.

Also, preventing the guide cylinder from rotating about the longitudinal direction and assembling the mechanical pencil with a side button may turn out to be difficult to perform in reliable and simple manner.

SUMMARY

The present disclosure aims to remedy those above-mentioned drawbacks, at least in part.

To this end, the present disclosure provides a mechanical pencil comprising a barrel extending in a longitudinal direction, a lead-propelling mechanism, a lead reservoir, a side button, and an eraser-propelling mechanism having a helical cam, the lead-propelling mechanism, the lead reservoir, the eraser-propelling mechanism, and the side button being at least partly housed inside the barrel, the lead-propelling mechanism, the lead reservoir, and the eraser-propelling mechanism being prevented from rotating about the longitudinal direction relative to one another and relative to the side button, and the side button is prevented from rotating about the longitudinal direction relative to the barrel.

By means of this arrangement, the eraser-propelling mechanism is prevented from rotating about the longitudinal direction relative to the barrel by means of the side button.

The eraser-propelling mechanism is prevented from rotating relative to the barrel since the eraser-propelling mechanism, the lead reservoir, and the lead-propelling mechanism are prevented from rotating about the longitudinal direction relative to one another and relative to the side button, said side button also being prevented from rotating about the longitudinal direction relative to the barrel. Thus, indirectly, the eraser-propelling mechanism is prevented from rotating about the longitudinal direction relative to the barrel. It should thus be understood that the eraser-propelling mechanism, the lead reservoir, and the lead-propelling mechanism are coupled to rotate with one another. In particular, the eraser-propelling mechanism is coupled to rotate with the lead reservoir and the lead reservoir is prevented from rotating with the eraser-propelling mechanism.

The eraser-propelling mechanism is thus not prevented from rotating by direct cooperation between the eraser-propelling mechanism and the barrel. It is therefore not necessary to provide mechanical means for clamping the eraser-propelling mechanism in the barrel and/or grooves and/or ribs in the barrel.

It should be understood that the eraser-propelling mechanism and the lead-propelling mechanism may each comprise portions that are free to rotate about the longitudinal direction. Also, whenever at least one portion of the eraser-propelling mechanism or of the lead-propelling mechanism is prevented from rotating about the longitudinal direction, it should be considered that the eraser-propelling mechanism or the lead-propelling mechanism is prevented from rotating about the longitudinal direction.

It should also be understood that when two elements are prevented from rotating about the longitudinal direction, the elements are able to pivot relative to each other about the longitudinal direction by a few degrees, e.g. by a maximum of 2°. There may be functional clearances between the various parts so as to enable the parts to be inserted in one another. These functional clearances allow two elements to pivot relative to each other even though these two elements are prevented from rotating relative to each other in the longitudinal direction.

The barrel may include a slot extending in the longitudinal direction and the side button comprises an actuator portion and an annular ring, connected together by a stem, the side button being prevented from rotating about the longitudinal direction by cooperation in abutment between the stem and the slot.

This arrangement makes it possible to prevent the side button and the barrel from rotating about the longitudinal direction. The stem is prevented from rotating by cooperating in abutment with the longitudinally-extending sides of the slot. In addition, since the slot extends in the longitudinal direction, the side button may be moved along said direction in order to actuate the lead-propelling mechanism.

The annular ring may have an outside surface that is substantially spherical.

It should be understood that if the outside surface of the annular ring is extended, a sphere or a substantially spherical volume is obtained. It should be understood that, the term "substantially spherical" means that three orthogonal axes passing through the center of the sphere need not be strictly equal. The length of a first of the three axes may lie in the range 95% to 105% of the length of a second of the three axes. The shape of the outside surface makes it possible to rotate the side button in the barrel while assembling the mechanical pencil by reducing the risks of the outside surface of the annular ring jamming with an inside wall of the barrel. Since the outside surface is substantially spherical, a maximum diameter of the annular ring may correspond to an inside diameter of the barrel in such a manner as to reduce clearance between the annular ring and the barrel, once the annular ring has been inserted into the barrel. It is thus possible to limit the surface area of contact between the ring and the barrel to a generator line.

The side button may include an annular ring arranged inside the barrel, and the lead-propelling mechanism may include a chuck holder, the chuck holder being prevented from rotating about the longitudinal direction relative to the annular ring.

Cooperation in abutment between the surfaces of the chuck holder and the annular ring prevents the side button from rotating about the longitudinal direction relative to the lead-propelling mechanism.

The lead-propelling mechanism may include a chuck holder, the lead reservoir being prevented from rotating about the longitudinal direction relative to the chuck holder.

Cooperation in abutment between the surfaces of the chuck holder and the lead reservoir prevents the lead-propelling mechanism from rotating about the longitudinal direction relative to the reservoir.

The eraser-propelling mechanism may include a guide cylinder prevented from rotating about the longitudinal direction relative to the lead reservoir.

Cooperation in abutment between the surfaces of the guide cylinder and the lead reservoir prevents the eraser-propelling mechanism from rotating about the longitudinal direction relative to the lead reservoir.

The lead reservoir and the eraser-propelling mechanism may be coupled together longitudinally.

It is thus possible to actuate the lead-propelling mechanism by pressing against the eraser-propelling mechanism, in particular by pressing against the eraser. It should be understood that when two elements are coupled together longitudinally, they move together, in the same direction, along the longitudinal direction L.

The longitudinal coupling between the lead-propelling mechanism and the lead reservoir may present a force that is greater than a longitudinal coupling force between the lead reservoir and the lead-propelling mechanism.

Thus, when the eraser-propelling mechanism is pulled out of the barrel, since the coupling force between the lead-propelling mechanism and the lead reservoir is greater than the coupling force between the lead reservoir and the eraser-propelling mechanism, the coupling between the lead reservoir and the eraser-propelling mechanism releases first. It is then possible to fill the lead reservoir. It is therefore possible to refill the mechanical pencil with leads.

This coupling method is easy to perform.

Rotating about the longitudinal direction may be prevented at least by a system for preventing rotating that includes a plurality of ribs, each rib including a beveled longitudinal end.

Since the system for preventing rotating includes a plurality of ribs, it is easier to position the various elements angularly relative to one another. Specifically, if the system for preventing rotating were to have only one rib, the two elements to be prevented from rotating would be able to cooperate in only one single position. As the number of ribs increases, so does the number of relative angular positions in which the elements can cooperate with one another. Assembly is therefore made easier.

The present disclosure further provides a method of assembling a mechanical pencil comprising the steps of:

- providing a barrel extending in a longitudinal direction, a lead-propelling mechanism, a lead reservoir, an eraser-propelling mechanism having a helical cam, and a side button;
- preventing the side button from rotating about the longitudinal direction relative to the barrel;
- inserting the lead-propelling mechanism into the barrel and preventing the lead-propelling mechanism from rotating about the longitudinal direction relative to the side button;
- assembling the eraser-propelling mechanism and the lead reservoir together and preventing the eraser-propelling mechanism from rotating about the longitudinal direction relative to the lead reservoir; and
- inserting the lead reservoir and the eraser-propelling mechanism in the barrel and preventing the lead reservoir mechanism from rotating about the longitudinal direction relative to the lead-propelling mechanism.

Assembling the mechanical pencil is relatively easy. The lead-propelling mechanism and the eraser-propelling mechanism may each be assembled outside of the barrel and the eraser-propelling mechanism may also be assembled to the lead reservoir outside of the barrel.

Thus, after inserting the side button in part into the barrel, two sub-assemblies are placed inside the barrel. The lead reservoir and the eraser-propelling mechanism may be coupled together longitudinally.

In addition, preventing rotating about the longitudinal direction does not require the presence of ribs in the barrel. The eraser-propelling mechanism is prevented from rotating relative to the barrel since the eraser-propelling mechanism is prevented from rotating about the longitudinal direction relative to the lead reservoir, which is itself prevented from rotating about the longitudinal direction relative to the lead-propelling mechanism, the mechanism also being prevented from rotating about the longitudinal direction relative to the side button, the side button being prevented from rotating about the longitudinal direction relative to the barrel.

The side button may comprise an actuator portion and an annular ring connected together by a stem presenting an axis, the barrel may include a slot extending in the longitudinal direction, and the annular ring of the side button may be inserted into the slot of the barrel and the side button may be rotated through 90° about the axis of the stem, the side button being prevented from rotating about the longitudinal direction by cooperation in abutment between the stem and the slot.

By means of its shape, the annular ring can be inserted into the slot in a configuration in which the annular ring is positioned at 90° relative to an in-use configuration of the side button, and then the side button can be rotated in such a manner that an axis of the annular ring, which was perpendicular to the longitudinal direction during insertion of the annular ring in the barrel, becomes parallel to the longitudinal direction.

The lead-propelling mechanism, the lead reservoir, and the eraser-propelling mechanism may be coupled together longitudinally.

BRIEF DESCRIPTION OF THE DRAWINGS

Other characteristics and advantages appear from the following description of embodiments of the invention, given by way of non-limiting example and with reference to the accompanying figures, in which.

DETAILED DESCRIPTION

Figure 1:
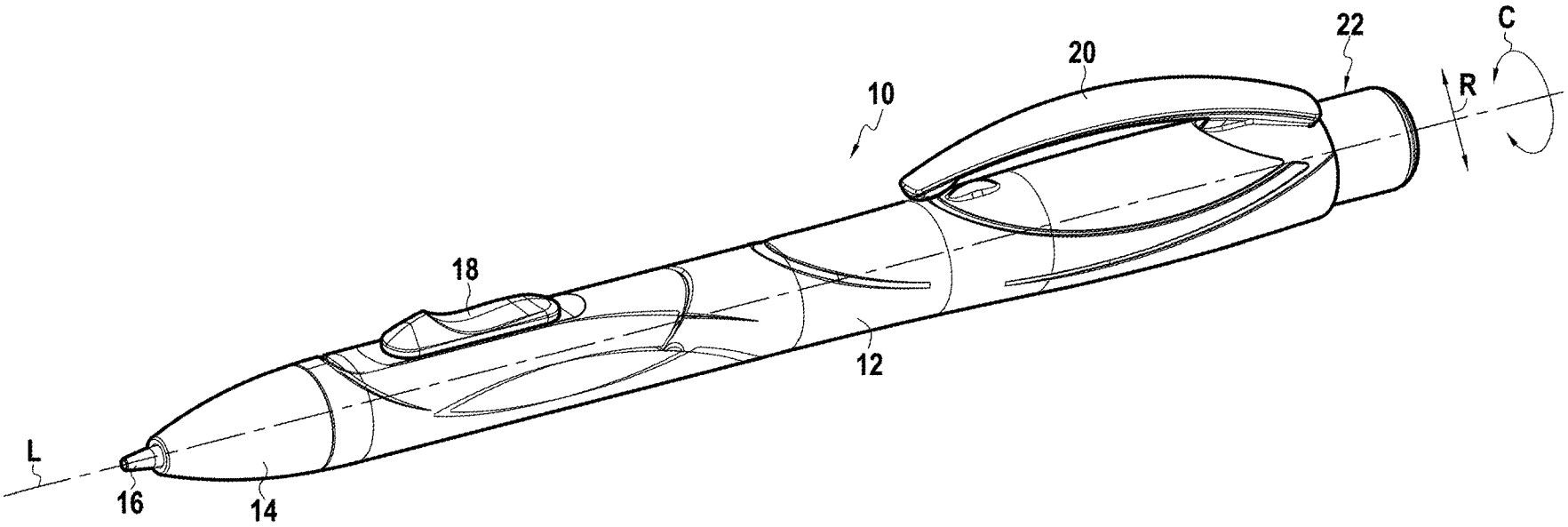
FIG. 1 is a perspective view of a mechanical pencil in one embodiment of the mechanical pencil.

FIG. 1 shows a mechanical pencil 10 comprising a barrel 12 extending in a longitudinal direction L, a nose 14 screw-fastened onto a front end 12A of the barrel 12, a lead sleeve 16, a side button 18, a clip 20 arranged at a rear end 12B of the barrel, and an eraser-propelling mechanism 22.

Below, the terms "front" and "rear" should be understood in reference to these front and rear ends 12A, 12B in the longitudinal direction L.

In general manner, the longitudinal direction corresponds to the direction of the axis L of the barrel, and the radial direction R is a direction perpendicular to the longitudinal direction L. The circumferential direction C corresponds to the direction describing a ring around the longitudinal direction L. These three directions, i.e. the longitudinal, radial, and circumferential (or azimuth) directions correspond respectively to the directions defined by the height, the radius, and the angle in a cylindrical coordinate system. Finally, unless specified to the contrary, the adjectives "inner" and "outer" are used with reference to a radial direction such that an inner portion (i.e. a radially inner portion) is closer to the axis L than is an outer portion (i.e. a radially outer portion) of the same element.

Figure 2:
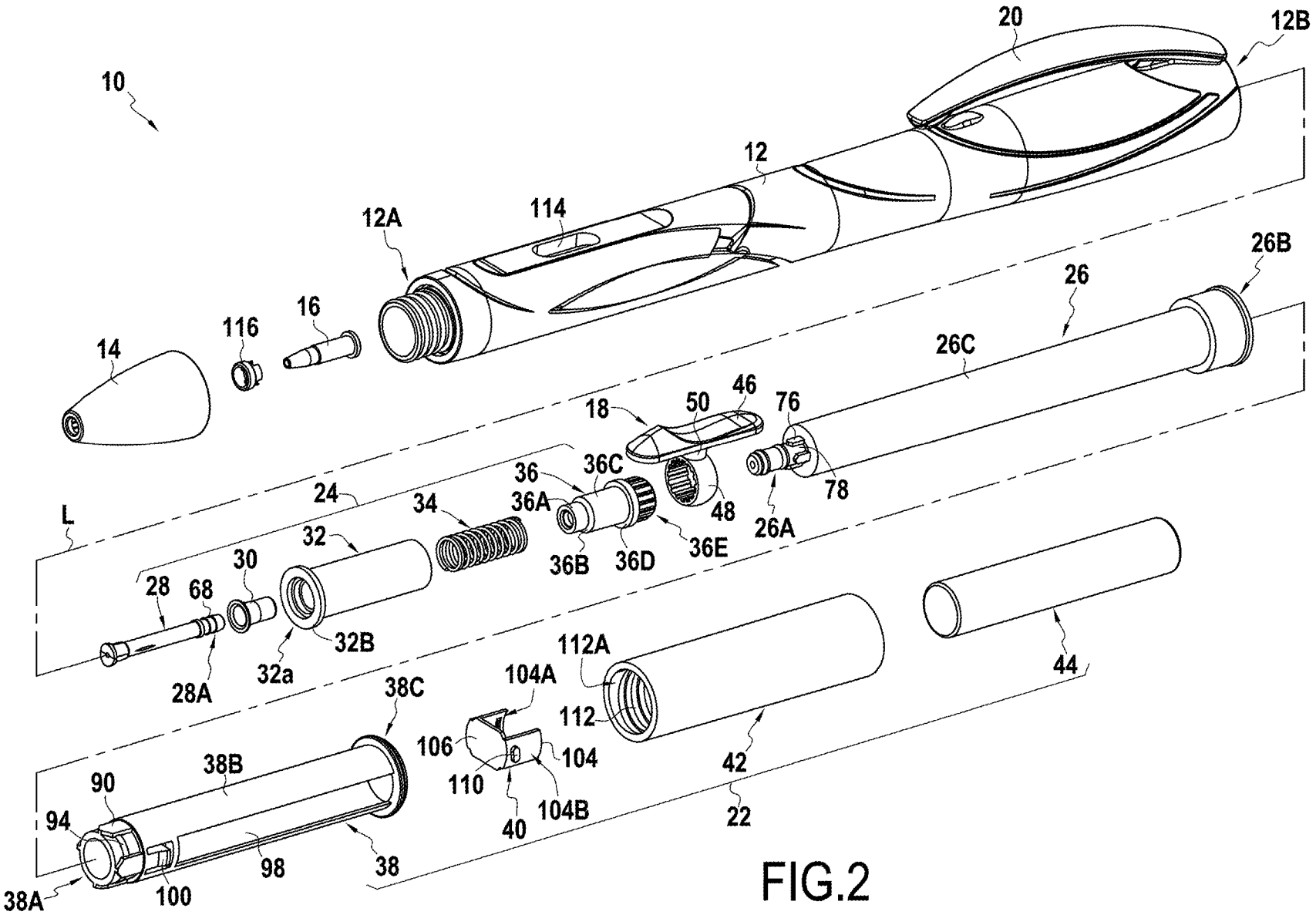
FIG. 2 is an exploded view of the FIG. 1 mechanical pencil shown from a first perspective.
Figure 3:
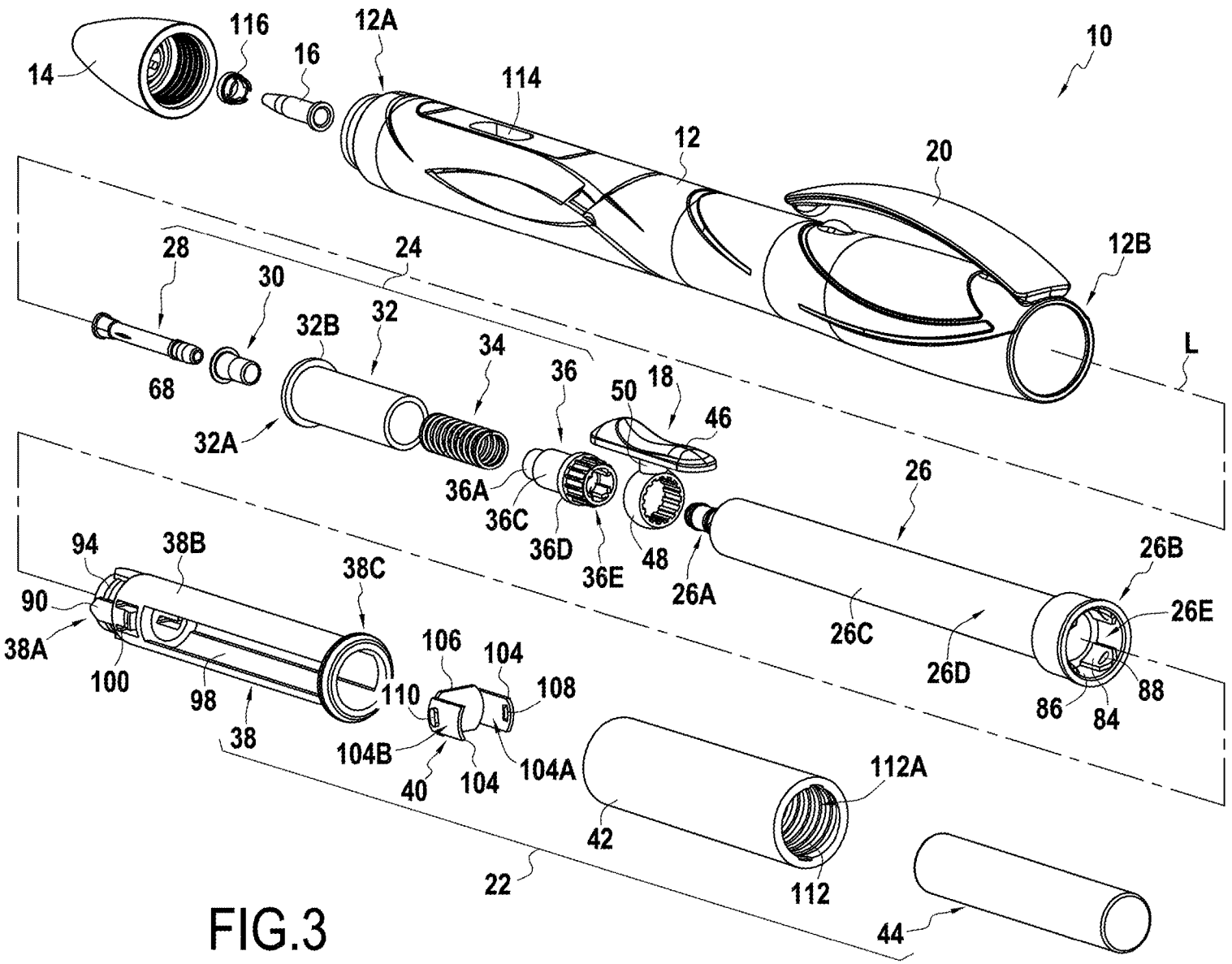
FIG. 3 is a second exploded perspective view of the FIG. 1 mechanical pencil shown from a second perspective.

FIGS. 2 and 3 are two exploded views of the mechanical pencil 10 of FIG. 1 shown from different perspectives.

The mechanical pencil 10 also comprises a lead-propelling mechanism 24 and a lead reservoir 26.

The lead-propelling mechanism 24 comprises a chuck 28, a clamping ring 30, a chuck sleeve 32, a spring 34, and a chuck holder 36.

The eraser-propelling mechanism 22 comprises a guide cylinder 38, an eraser holder 40, a tube 42, and an eraser 44.

The side button 18 is described below in greater detail with reference to FIG. 4. The side button 18 comprises an actuator portion 46 and an annular ring 48 that are connected together by a stem 50. The annular ring 48 has an outside surface 52 that is substantially spherical and an inside surface 54 having a plurality of longitudinal ribs 56 spaced apart from one another in regular manner. The spaces between the ribs 56 form grooves 58. It should be understood that the ribs 56 and the grooves 58 are parallel to the axis L of the mechanical pencil 10 when the side button 18 is in its in-use configuration. In the in-use configuration, the axis of the annular ring 48 is parallel to the axis L of the mechanical pencil 10, it coincides with the axis L of the mechanical pencil 10.

It should be observed that in the in-use configuration of the side button 18, the stem 50 presents an axis A that is oriented in the radial direction R.

Figure 5A:
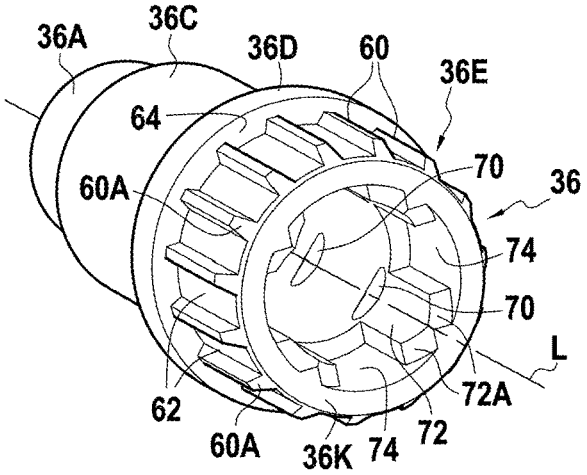
FIGS. 5A and 5B are views on a larger scale of the clip holder shown in FIG. 2, shown respectively in perspective and in longitudinal section.
Figure 5B:
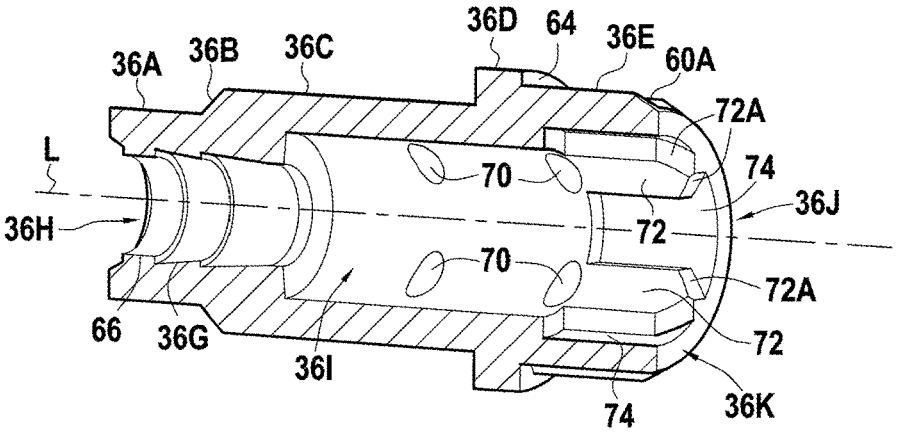

FIGS. 5A and 5B are perspective views, of the chuck holder 36 of the lead-propelling mechanism, as seen respectively from the rear and from the front. In the embodiment in FIGS. 5A and 5B, the chuck holder 36 comprises, from the front to the rear, a first cylindrical portion 36A and a second cylindrical portion 36C connected together by a conical intermediate portion 36B. Thereafter, the chuck holder 36 comprises a third cylindrical portion 36E connected to the second cylindrical portion 36C by a collar 36D.

On its outside surface 36F, the third cylindrical portion 36E has longitudinal ribs 60 spaced apart from one another in regular manner. The spaces between the ribs 60 form grooves 62. It should be understood that the ribs 60 and the grooves 62 are parallel to the axis L of the mechanical pencil 10 when the chuck holder 36 is assembled in the mechanical pencil 10, i.e. when the chuck holder 36 is in its in-use configuration.

The ribs 60 and the grooves 62 of the chuck holder 36 are configured to cooperate with the ribs 56 and the grooves 58 on the inside surface 54 of the annular ring 48 so as to prevent the chuck holder 36 from rotating about the longitudinal direction L relative to the side button 18. In addition, an abutment surface 64 of the collar 36D of the chuck holder 36 is designed to cooperate with an abutment surface 48A of the annular ring 48.

The chuck holder 36 is hollow and comprises an inside surface 36G having a front portion 36H with annular portions in relief 66 that are configured to cooperate with complementary annular portions in relief 68 on a rear end 28A of the chuck 28 in such a manner as to block the chuck 28 inside the chuck holder 36 in the longitudinal direction L.

The inside surface 36G of the chuck holder 36 includes an intermediate portion 36I that has portions in relief 70 of oblong shape. In the embodiment of FIGS. 5A and 5B, the rear portion 36I has eight oblong-shaped portions in relief 70 distributed in two groups of four portions in relief along the longitudinal direction L. Each group comprises four oblong-shaped portions in relief 70 uniformly distributed in the circumferential direction C.

The inside surface 36G of the chuck holder 36 also includes a rear portion 36J of the chuck holder 36 that has longitudinal ribs 72 spaced apart from one another in regular manner, there being four longitudinal ribs 72 in the embodiment in FIGS. 5A and 5B. The spaces between the ribs 72 form grooves 74. It should be understood that the ribs 72 and the grooves 74 are parallel to the axis L of the mechanical pencil 10 when the chuck holder 36 is assembled in the mechanical pencil 10, i.e. when the chuck holder 36 is in its in-use configuration.

As shown in FIGS. 5A and 5B, each rib 60 presents a beveled face 60A on its rear longitudinal end.

While the chuck holder 28 and the side button 18 are being assembled together, the beveled faces 60A make it easier to insert the chuck holder 28 in the annular ring 48 of the side button 18. In particular, when the ribs and grooves are not correctly aligned, they facilitate bringing them into alignment and therefore make it easier to assemble the chuck holder 28 in the side button 18.

Similarly, each rib 72 presents two beveled faces 72A on its rear longitudinal end.

Figure 6A:
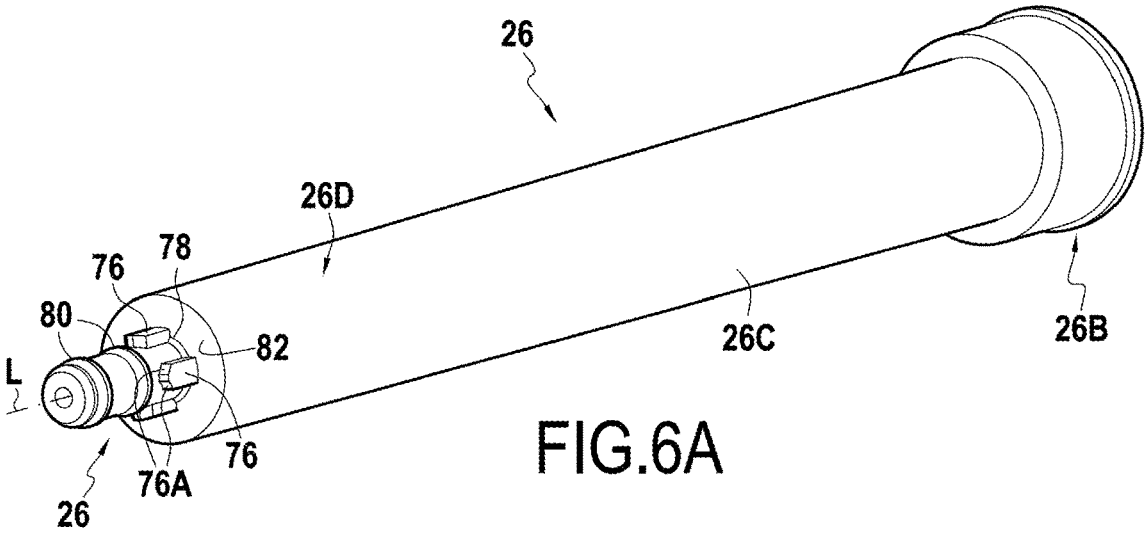
FIGS. 6A and 6B are perspective views on a larger scale of first and second ends of the lead reservoir shown in FIG. 2.
Figure 6B:
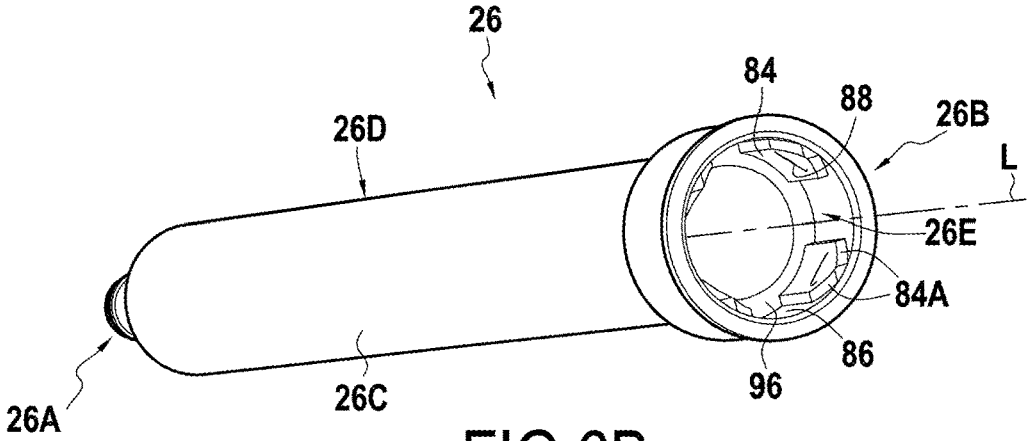

FIGS. 6A and 6B are perspective views of a front end 26A and a rear end 26B of the lead reservoir 26. Between these two ends 26A, 26B, the lead reservoir 26 comprises a reservoir body 26C of substantially cylindrical shape for receiving the leads and extending in the longitudinal direction L.

As shown in FIG. 6A, the front end 26A of the lead reservoir comprises, from front to rear, two annular flanges 80 and four longitudinal ribs 76 spaced apart from one another in regular manner. Each rib 76 presents two beveled faces 76A on a front longitudinal end. The spaces between the ribs 76 form grooves 78. The ribs 76, the grooves 78, and the annular flanges 80 are located on an outside surface 26D of the lead reservoir.

The ribs 76 and the grooves 78 at the front end 26A of the lead reservoir 26 are configured to cooperate with the ribs 72 and grooves 74 located on the rear portion 36J of the inside surface 36G of the chuck holder 36 in such a manner as to prevent the lead reservoir 26 rotating about the longitudinal direction L relative to the chuck holder 36. Furthermore, the annular flanges 80 at the front end 26A of the lead reservoir 26 are configured to cooperate with the oblong-shaped portions in relief 70 located on the intermediate portion 36I of the inside surface 36G of the chuck holder 36 so as to couple the lead reservoir 26 and the chuck holder 36 together longitudinally. In addition, the lead reservoir 26 presents a shoulder 82 for coming into abutment against a rear abutment surface 36K of the chuck holder 36.

While assembling the chuck holder 28 and the lead reservoir 26 together, the beveled faces 72A of the ribs 72 and the beveled faces 76A of the ribs 76 make it easier to insert the front end 26A of the lead reservoir 26 into the third cylindrical portion 36E of the chuck holder 28. In particular when the ribs and grooves are not correctly aligned, the beveled faces serve to facilitate bringing them into alignment during assembly, by making it easier for the lead reservoir 26 to rotate about the longitudinal direction L relative to the chuck holder 28.

As shown in FIG. 6B, the rear end 26B of the lead reservoir 26 has an inside surface 26E on which there are located four longitudinal ribs 84 spaced apart from one another in regular manner. Each rib 84 presents two beveled faces 84A on a rear longitudinal end and carries a portion in relief 88 of oblong shape. The spaces between the ribs 84 form grooves 86.

Figure 7:
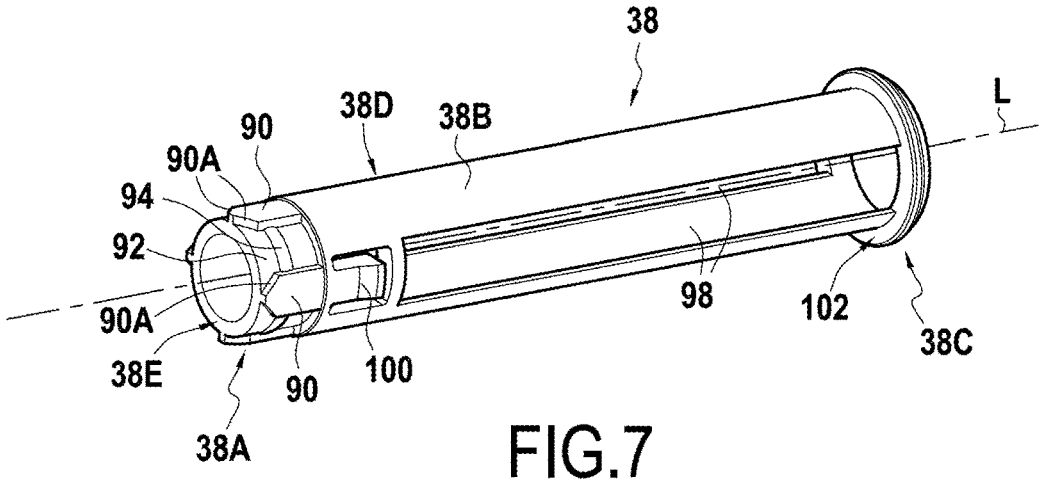
FIG. 7 is a perspective view on a larger scale of the guide cylinder shown in FIG. 2.

FIG. 7 is a perspective view of the guide cylinder 38 of the eraser-propelling mechanism 22.

The guide cylinder 38 has a front end 38A and a rear end 38C, which ends 38A, 38C are connected together by a body 38B. On its outside surface 38D, the front end 38A has four longitudinal ribs 90 spaced apart from one another in regular manner. Each rib 90 presents two beveled faces 90A on a front longitudinal end. The spaces between the ribs 90 form grooves 92. An annular flange 94 is arranged in the grooves 92. The annular flange 94 presents thickness in the radial direction R that is less than a thickness of the ribs 90 in this same radial direction R. The thickness of the ribs 90 is measured immediately adjacent to the annular flange 94.

The ribs 90 and the grooves 92 at the front end 38A of the guide cylinder 38 are configured to cooperate with the ribs 84 and grooves 86 located on the inside surface 26E at the rear end 26B of the lead reservoir 26 in such a manner as to prevent the guide cylinder 38 from rotating about the longitudinal direction L relative to the lead reservoir 26. Furthermore, the annular flange 94 at the front end 38A of the guide cylinder 38 is configured to cooperate with the oblong-shaped portions in relief 88 located on the lugs 84 at the rear end 26G of the lead reservoir 26 so as to couple the guide cylinder 38 and the lead reservoir 26 together longitudinally. In addition, the lead reservoir 26 presents a shoulder 96 for coming into abutment against a front abutment surface 38E of the guide cylinder 38.

While assembling the lead reservoir 26 and the guide cylinder 38 together, the beveled faces 84A of the ribs 84 and the beveled faces 90A of the ribs 90 make it easier to insert the front end 38A of the guide cylinder 38 in the rear end 26B of the lead reservoir 26. In particular when the ribs and grooves are not correctly aligned, the beveled faces serve to facilitate bringing them into alignment during assembly, by making it easier for the guide cylinder 38 to rotate about the longitudinal direction L relative to the lead reservoir 26.

The body 38B of the guide cylinder 38 is of cylindrical shape and extends in a longitudinal direction L. The body 38B has two slots 98 extending in the longitudinal direction and diametrically opposite each other. The two slots 98 are configured to receive and to guide the eraser holder 40.

Between the slots 98 and the ribs 90 in the longitudinal direction L, the body 38B of the guide cylinder also comprises a pair of resilient lugs 100.

The rear end 38C of the guide cylinder 38 includes an annular abutment surface 102.

As shown in FIGS. 2 and 3, the eraser holder 40 is generally U-shaped presenting two flanks 104 connected together by a base 106. The two flanks 104 are configured to slide in the slots 98 of the guide cylinder 38.

On an inside surface 104A, each flank 104 carries a hook 108 for retaining the eraser 44 and, on an outside surface 1048, a stud 110 configured to slide in a helical cam 112 located on an inside surface of the tube 42. It should thus be understood that the tube 42 includes two helical cams 112 interleaved with each other.

The method of assembling the mechanical pencil 10 is described below with reference to FIGS. 8 to 11.

In the embodiment of the mechanical pencil 10 shown in FIGS. 1 to 7, the mechanical pencil 10 is assembled in a certain order that is described below.

There are provided: the barrel 12 extending in the longitudinal direction L; the lead-propelling mechanism 24; the lead reservoir 26; the eraser-propelling mechanism 22; and the side button 18.

The lead-propelling mechanism 24 is assembled by inserting the clamping ring 30 in the chuck sleeve 32. The spring 34 is then inserted between the clamping ring 30 and the chuck sleeve 32. The chuck holder 36 is inserted in the chuck sleeve 32 via the rear of the chuck sleeve 32 and the chuck 28 is inserted via the front of the chuck sleeve 32 until the annular portions in relief 68 at the rear end 28A of the chuck 28 snap-fasten together longitudinally with the annular portions in relief 66 of the front portion 36H of the inside surface 36G of the chuck holder 36.

Figure 9:
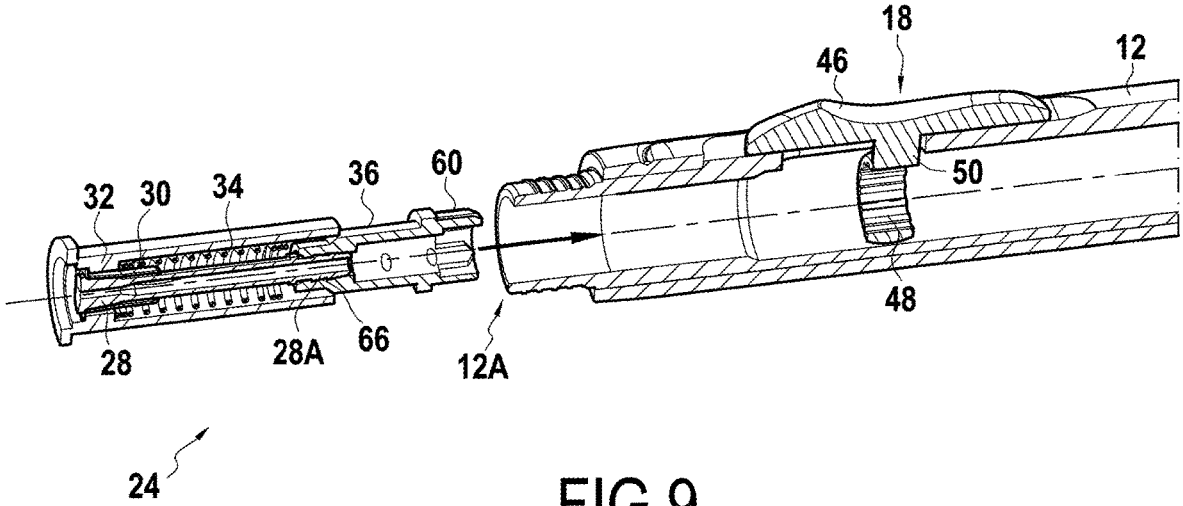
FIG. 9 is a section view of the mechanical pencil, the side button already being inserted into the barrel, and the lead-propelling mechanism being preassembled and ready to be inserted into the barrel.

As shown in FIG. 9, the lead-propelling mechanism 24 is assembled and ready to be mounted in the mechanical pencil 10.

It should be understood in particular that the chuck sleeve 32 is free to rotate about the longitudinal direction L relative to the chuck holder 36.

In order to assemble the eraser-propelling mechanism 22, the eraser holder 40 is inserted in the guide cylinder 38 and more particularly, each flank 104 is inserted in one of the slots 98 of the guide cylinder 38. The guide cylinder 38 is inserted into the tube 42 by its front end 38A. During insertion of the guide cylinder 38, the resilient lugs 100 deform towards the inside of the guide cylinder 38. Then, the studs 110 are inserted into the helical cams 112 of the tube 42 and the tube 42 is rotated about the longitudinal direction L until the tube 42 passes completely over the resilient lugs 100. Under the effect of their own resilience, since the resilient lugs 100 are no longer being forced into the guide cylinder 38 by the tube 42, the resilient lugs go back to their initial position and block the tube 42 longitudinally between the abutment surface 102 at the rear end 38C of the guide cylinder 38 and the resilient lugs 100. It should be understood that longitudinal blocking may be performed with negligible clearance that corresponds to manufacturing tolerances. Then, the eraser 44 is inserted into the eraser holder 40 and the tube 42 is rotated about the longitudinal direction L relative to the guide cylinder 38 in such a manner that the eraser 44 extends a little beyond the rear end 38C of the guide cylinder 38.

The eraser-propelling mechanism 22 with a helical cam 112 is assembled.

It should be understood that there may be variations in the way the eraser-propelling mechanism 22 with a helical cam 112 is assembled. By way of example, the eraser 44 may be inserted in the eraser holder 40 after placing the flanks 104 in the slots 98.

The front end 38A of the guide cylinder 38 is then inserted in the rear end 26B of the lead reservoir 26 until the annular flanges 94 located at the front end 38A of the guide cylinder snap-fasten longitudinally with the oblong-shaped portions in relief 88 located on the ribs 84 at the rear end 26B of the lead reservoir 26.

The beveled faces 90A of the ribs 90 at the front end 38A of the guide cylinder 38 cooperate with the beveled faces 84A of the ribs 84 at the rear end 26B of the lead reservoir 26 so as to bring the ribs 90 into alignment with the grooves 86 at the rear end 26B of the lead reservoir 26 and to align the ribs 84 with the grooves 92 at the front end 38A of the guide cylinder 38.

The guide cylinder 36 is thus prevented from rotating about the longitudinal direction L relative to the lead reservoir 26 by the ribs 84, 90 cooperating in abutment with the grooves 86, 92.

In general, it can be said that the eraser-propelling mechanism 22 is prevented from rotating about the longitudinal direction L relative to the lead reservoir 26. However, it should be understood that the tube 42 is not prevented from rotating about the longitudinal direction L relative to the lead reservoir 26.

The guide cylinder 38 is also coupled longitudinally with the lead reservoir 26 by snap-fastening the annular flanges 94 located at the front end 38A of the guide cylinder longitudinally with the oblong-shaped portions in relief 88 located on the ribs 84 at the rear end 26B of the lead reservoir 26.

In general, it can be said that the eraser-propelling mechanism 22 is coupled longitudinally with the lead reservoir 26. However, it should be understood that the eraser holder 40 and the eraser 44 need not be coupled with the lead reservoir 26, in the sense that, when the tube 42 is rotated to cause the eraser 44 to extend or retract, the eraser holder 40 and the eraser 44 move longitudinally relative to the lead reservoir 26.

Figure 10:
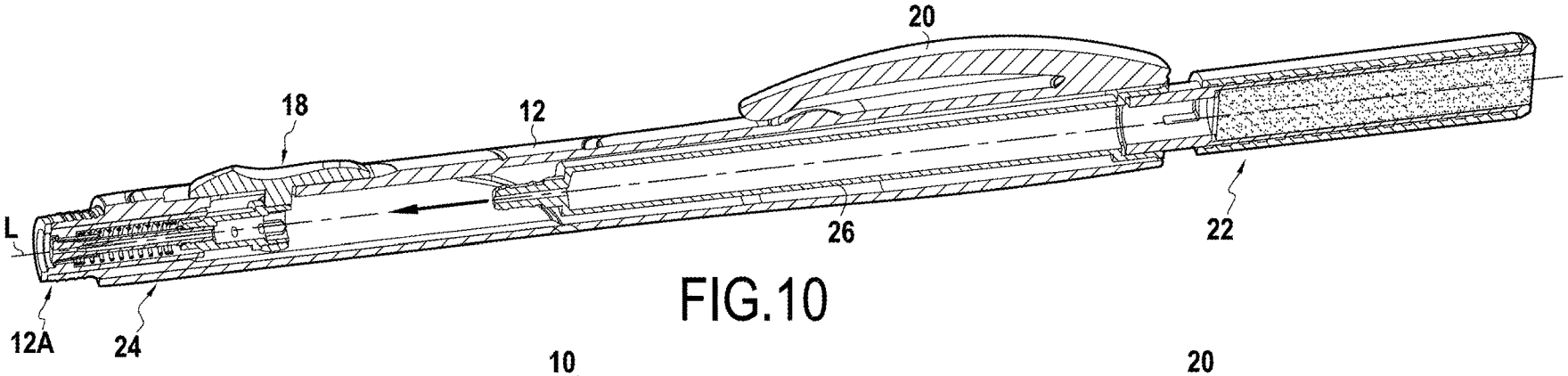
FIG. 10 is a section view of the mechanical pencil, the eraser-propelling mechanism and the lead reservoir being preassembled and ready to be inserted into the barrel.

The assembly formed by the lead reservoir 26 and the eraser-propelling mechanism 22 is therefore ready to be assembled in the barrel 12, as shown in FIG. 10.

Figure 4:
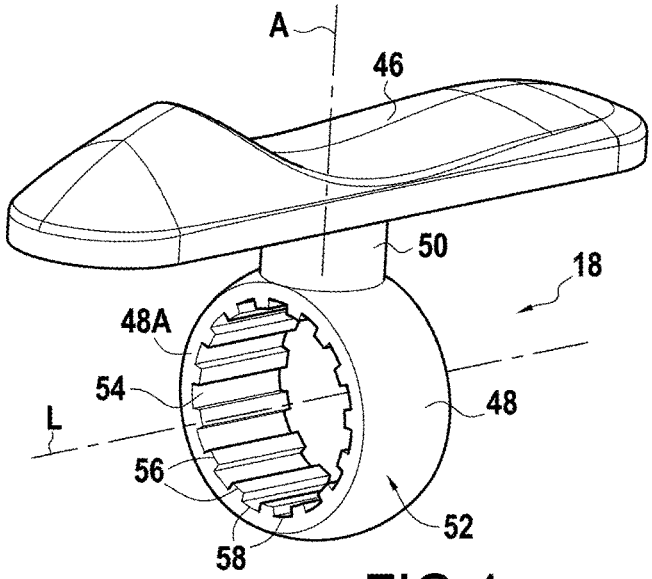
FIG. 4 is a perspective view on a larger scale of the side button shown in FIG. 2.
Figure 8:
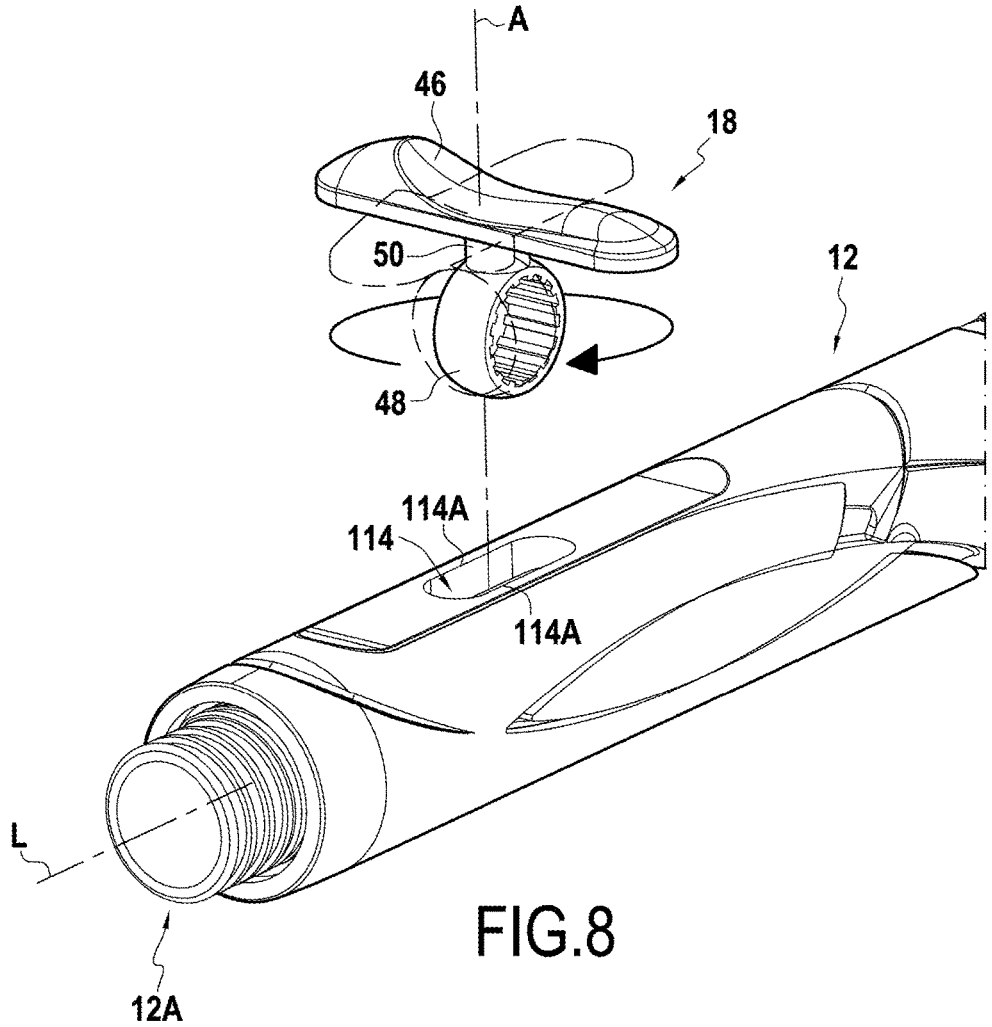
FIG. 8 is a perspective view showing the side button before it is inserted into the barrel.

As shown in FIG. 8, the barrel 12 includes a slot 114 extending in the longitudinal direction L and having a shape and dimensions corresponding to the widest section of the annular ring 48 taken on a plane containing a diameter of the annular ring 48 and containing the axis L (see FIG. 4).

The side button 18 is shown in dashed lines in its in-use configuration that it occupies once the annular ring 48 has been inserted into the barrel 12. In order to insert the side button 18 into the slot of the barrel 12, the side button is rotated about the axis A of the stem 50 through 90° into the position shown in continuous lines in FIG. 8, so that the axis L of the annular ring 48 is then perpendicular to the axis L of the barrel 12.

The annular ring 48 is inserted in the slot until the side button 18 comes into abutment against the barrel 12. In this position, the annular ring 48 is fully inserted inside the barrel 12, the actuator portion 46 is outside the barrel 12 and the stem 50 is in the slot 114 of the barrel. The side button 18 is rotated about the axis A of the stem 50 through 90° so as to bring the axis L of the side button 18 into alignment with the axis L of the barrel 12.

The side button 18 is thus prevented from rotating about the longitudinal direction by the stem 50 cooperating in abutment with the slot 114, in particular with the longitudinally-extending sides 114A of the slot 114. The stem 50 is cylindrical and presents a diameter equal to or close to the width of the slot 114 (to within manufacturing tolerances). It should be understood that the barrel 12 presents thickness in the radial direction R that is less than or equal to a length of the stem 50 along the axis A. The side button 18 is thus prevented from rotating about the longitudinal direction relative to the barrel 12.

As shown in FIG. 9, the side button 18, in particular its annular ring 48, is inserted into the barrel 12 through the slot 114 in the barrel 12 and the lead-propelling mechanism 24 is ready to be inserted into the barrel 12 through the front end 12A of the barrel 12.

The side button 18 may be arranged at the front of the slot 114. The ribs 60 and the grooves 62 located on the third cylindrical portion 36E of the chuck holder 36 are brought into contact with the ribs 56 and the grooves 58 located on the inside surface 54 of the annular ring 48. If the ribs 60 are not in alignment in the circumferential direction C with the grooves 58, or conversely if the grooves 62 are not in alignment in the circumferential direction C with the ribs 56, the beveled faces 60A together with the resilience of the spring 34 makes it possible for the chuck holder 36 to rotate about the longitudinal direction L so as to bring the ribs 60, 56 into alignment with the grooves 58, 62. This rotating can be performed easily. While being inserted into the barrel 12, the lead-propelling mechanism is held by a front end 32A of the chuck sleeve 32. However, as described above, the chuck sleeve 32 is free to rotate relative to the chuck holder 36 so that the chuck holder 36 can rotate about the longitudinal direction L so as to bring the ribs 60, 56 into alignment with the grooves 58, 62. Having a considerable number of ribs 60, 56 and of grooves 58, 62 serves to reduce the amplitude through which the chuck holder 36 needs to rotate about the longitudinal direction L relative to the annular ring 48.

When the ribs 60, 56 and the grooves 58, 62 are in alignment, the chuck holder 36 can be inserted into the annular ring 48 until the abutment surface 64 of the collar 36D of the chuck holder 36 comes into abutment against the abutment surface 48A of the annular ring 48 and until an annular shoulder 32B at the front end 32A of the chuck sleeve 32 comes into abutment against the front end 12A of the barrel 12.

The chuck holder 36 is thus prevented from rotating about the longitudinal direction L relative to the annular ring 26 by the ribs 60, 56 cooperating in abutment with the grooves 58, 62.

In general, it can be said that the lead-propelling mechanism is prevented from rotating about the longitudinal direction L relative to the side button 18. However, it should be understood that the chuck sleeve 32 is not prevented from rotating about the longitudinal direction L relative to the side button 18.

As shown in FIG. 10, the lead-propelling mechanism 24 is thus assembled inside the barrel 12 and the assembly formed by the lead reservoir 26 and the eraser-propelling mechanism 22 is ready to be inserted into the barrel 12 via the rear end 12B of the barrel.

The lead-propelling mechanism 24, and in particular the shoulder 32B of the chuck sleeve 32, is held against the front end 12A of the barrel 12 by means of the conical endpiece 14 that is screw-fastened at the front end 12A of the barrel 12, and the front end 26A of the lead reservoir 26 is inserted into the barrel 12.

The assembly formed by the lead reservoir 26 and the eraser-propelling mechanism 22 may be held by the tube 42 of the eraser-propelling mechanism 22.

When the front end 26A of the lead reservoir is brought into contact with the third cylindrical portion 36E, the ribs 76 and the grooves 78 located on the outside surface 26D of the lead reservoir 26 are brought into contact with the ribs 72 and the grooves 74 located on the rear portion 36J of the inside surface 36G of the chuck holder 36. If the ribs 76 are not in alignment in the circumferential direction C with the grooves 74, or conversely if the grooves 78 are not in alignment in the circumferential direction C with the ribs 74, the beveled faces 76A and 72A, respectively of the ribs 76 and 72, enable the lead reservoir 26 to rotate about the longitudinal direction L so as to bring the ribs 76, 72 into alignment with the grooves 74, 78. This rotating can be performed easily. While being inserted into the barrel 12, the eraser-propelling mechanism is held by the tube 42. However, as described above, the tube 42 is free to rotate relative to the guide cylinder 38 and to the lead reservoir 26, so that the lead reservoir 26 is able to rotate about the longitudinal direction L so as to bring the ribs 76, 72 into alignment with the grooves 74, 78.

The front end 26A of the lead reservoir 26 is inserted in the third cylindrical portion 36E of the chuck holder 36 until the annular flanges 80 located on the outside face 26D at the front end 26A of the lead reservoir 26 are coupled by longitudinal snap-fastening together with the oblong-shaped portions in relief 70 located on the intermediate portion 36I of the inside surface 36G of the chuck holder 36.

The lead reservoir 26 is thus prevented from rotating about the longitudinal direction L relative to the chuck holder 36 by the ribs 76, 72 cooperating in abutment with the grooves 74, 78.

In general, it can be said that the lead reservoir 26 is prevented from rotating about the longitudinal direction L relative to the lead-propelling mechanism 24.

In addition, it can be said that the eraser-propelling mechanism 24 is prevented from rotating about the longitudinal direction L relative to the lead-propelling mechanism 24. However, it should be understood that the tube 42 is not prevented from rotating about the longitudinal direction L relative to the lead-propelling mechanism 26.

The lead reservoir is also coupled longitudinally with the chuck holder 36 by the annular flanges 80 located on the outside face 26D at the front end 26A of the lead reservoir 26 snap-fastening longitudinally with the oblong-shaped portions in relief 70 located on the intermediate portion 36I of the inside surface 36G of the chuck holder 36.

In general, it can be said that the lead-propelling mechanism 24 is coupled longitudinally with the lead reservoir 26. However, it should be understood that the chuck sleeve 32 need not be coupled with the lead reservoir 26, in the sense that, when the side button 18 is actuated to extend a lead in the mechanical pencil 10, the chuck sleeve 32 does not move longitudinally with the lead reservoir 26.

In addition, it should be understood that since the chuck holder 36 is prevented from rotating about the longitudinal direction L relative to the side button 18, the lead reservoir 26 and the eraser-propelling mechanism are also prevented from rotating about the longitudinal direction L relative to the side button 18. Since the side button 18 is itself prevented from rotating about the longitudinal direction L relative to the barrel 12, the lead-propelling mechanism 24, the lead reservoir 26, and the eraser-propelling mechanism 22 are also prevented from rotating about the longitudinal direction L relative to the barrel 12. However, it should be understood that the tube 42 is not prevented from rotating about the longitudinal direction relative to the barrel 12.

Once the lead reservoir 26 is assembled inside the barrel 12, the ring 116 is placed around the lead sleeve 16 and they are inserted into the nose 14 that is screw-fastened at the front end 12A of the barrel. The shoulder 32B is clamped between the front end 12A of the barrel 12 and a portion of the nose 14. The mechanical pencil 10 is thus assembled.

It should be understood that the order of the assembly operations may be varied. It may be envisaged to assemble the nose 14 on the barrel 12 before inserting the assembly formed by the lead reservoir 26 and the eraser-propelling mechanism 22. The lead-propelling mechanism 24 and the eraser-propelling mechanism 22 may be assembled simultaneously at different stations.

However, in the embodiment described, the side button 18 is inserted into the barrel 12 before the lead-propelling mechanism 24 is inserted, and the lead-propelling mechanism 24 is inserted into the barrel before the assembly made up of the lead reservoir 26 and the eraser-propelling mechanism 22 is inserted.

Figure 11:
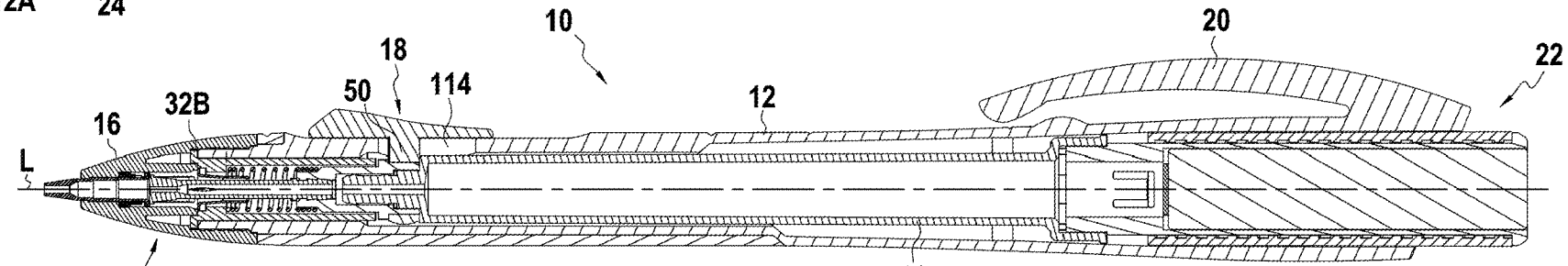
FIG. 11 is a section view of the mechanical pencil of FIG. 1 in its activated configuration.

As can be seen in FIG. 11, which shows the mechanical pencil 10 in an activated configuration, when the side button 18 is actuated and pushed forwards in order cause a lead in the mechanical pencil 10 to move forwards, the abutment surface 48A of the annular ring 48 presses forwards against the abutment surface 64 of the collar 36D of the chuck holder 36, and moves the chuck holder 36 forwards. Since the lead reservoir 26 and the eraser-propelling mechanism 22 are coupled together longitudinally with the lead-propelling mechanism 24, in particular with the chuck holder 36, the lead reservoir 26 and the eraser-propelling mechanism 22 also move forwards with the chuck holder 36.

Figure 12:
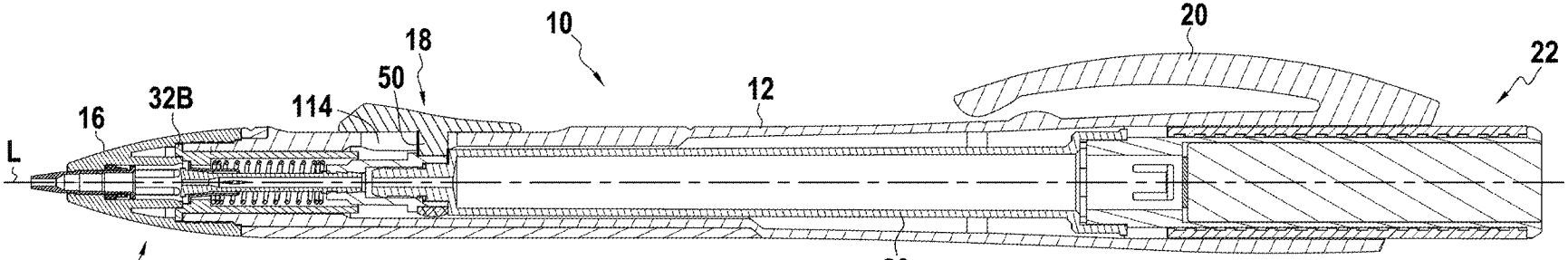
FIG. 12 is a similar view of the mechanical pencil of FIG. 1 in its rest configuration.

When the side button 18 is released, under the return force of the spring 34, the mechanical pencil returns to a rest configuration, shown in FIG. 12. The eraser-propelling mechanism 22, the lead reservoir 26, and the lead-propelling mechanism 24, in particular the chuck holder 36, move together towards the rear of the barrel 12.

It should be understood that since the eraser-propelling mechanism 22, the lead reservoir 26, and the lead-propelling mechanism 24 are coupled together longitudinally, it is also possible to cause the mechanical pencil 10 to take up the activated configuration by pressing forwards on the eraser-propelling mechanism 22 and by then stopping pressing.

The mechanical pencil 10 may be refillable. As a result, the longitudinal coupling between the lead reservoir 26 and the eraser-propelling mechanism 22 is designed in such a manner that the coupling provides a coupling force that is less than the other longitudinal coupling forces, in particular this coupling provides a longitudinal coupling force that is less than the longitudinal coupling force between the lead-propelling mechanism 24 and the lead reservoir 26. Thus, when the eraser-propelling mechanism 22 is pulled rearwards, the longitudinal coupling between the lead reservoir 26 and the eraser-propelling mechanism 22 releases before the longitudinal coupling between the lead-propelling mechanism 24 and the lead reservoir 26 thereby giving access to the lead reservoir 26, which can thus be filled with leads. Thereafter, the eraser-propelling mechanism 22 is inserted into the barrel 12 and in the rear end 26B of the lead reservoir 26, as described above.

In order to extend or retract the eraser 44, the tube 42 is rotated about the longitudinal direction relative to the barrel 12 in one direction or in the opposite direction, and since the guide cylinder 38 is prevented from rotating about the longitudinal direction relative to the barrel 12, the studs of the eraser holder 40 inserted in the helical cams 112 of the tube 42 transform the rotating movement of the tube 42 into a movement in longitudinal translation of the eraser holder 40 and the eraser 44, causing the eraser 44 to be extended or retracted.

Although the present disclosure is described with reference to a specific embodiment, it is clear that various modifications and changes can be made to that embodiment without going beyond the general scope of the invention as defined by the claims. In addition, individual above-mentioned characteristics of various embodiments may be combined in additional embodiments. Consequently, the description and the drawings should be considered in a sense that is illustrative rather than restrictive.

It should be understood that the shape of the reservoir body 26C is not limited to a cylinder. The reservoir body 26C could be slightly conical in shape. In addition, it should be observed that a barrel may have a base that is not a circle.

It should also be understood that the numbers and the shapes of the longitudinal ribs may vary and are given only by way of example. The same applies to the shapes and portions in relief that make it possible to couple the various elements of the mechanical pencil together longitudinally.

The invention claimed is:

1. A mechanical pencil comprising: a barrel extending in a longitudinal direction, a lead-propelling mechanism, a lead reservoir, a side button, and an eraser-propelling mechanism having a helical cam, the lead-propelling mechanism, the lead reservoir, the eraser-propelling mechanism, and the side button being at least partly housed inside the barrel, the lead-propelling mechanism, the lead reservoir, and the eraser-propelling mechanism being prevented from rotating about the longitudinal direction relative to one another and relative to the side button, and the side button is prevented from rotating about the longitudinal direction relative to the barrel, wherein rotation about the longitudinal direction is prevented by a system including a plurality of ribs, each rib including a beveled longitudinal end.

2. A mechanical pencil according to claim 1, wherein the lead-propelling mechanism is prevented from rotating about the longitudinal direction relative to the lead reservoir and the lead reservoir is prevented from rotating about the longitudinal direction relative to the eraser-propelling mechanism.

3. A mechanical pencil according to claim 1, wherein the lead-propelling mechanism is prevented from rotating about the longitudinal direction relative to the side button.

4. A mechanical pencil according to claim 1, wherein the barrel includes a slot extending in the longitudinal direction and the side button comprises an actuator portion and an annular ring, connected together by a stem, the side button being prevented from rotating about the longitudinal direction by cooperation between the stem and the slot.

5. A mechanical pencil according to claim 4, wherein the annular ring has an outside surface that is substantially spherical.

6. A mechanical pencil according to claim 1, wherein the side button includes an annular ring arranged inside the barrel, and wherein the lead-propelling mechanism includes a chuck holder, the chuck holder being prevented from rotating about the longitudinal direction relative to the annular ring.

7. A mechanical pencil according to claim 1, wherein the lead-propelling mechanism includes a chuck holder, the lead reservoir being prevented from rotating about the longitudinal direction relative to the chuck holder.

8. A mechanical pencil according to claim 1, wherein the eraser-propelling mechanism includes a guide cylinder prevented from rotating about the longitudinal direction relative to the lead reservoir.

9. A mechanical pencil according to claim 1, wherein the lead-propelling mechanism, the lead reservoir, and the eraser-propelling mechanism are coupled together longitudinally.

10. A mechanical pencil according to claim 9, wherein at least one longitudinal coupling is longitudinal snap-fastening.

11. A method of assembling a mechanical pencil comprising the steps of:

providing a barrel extending in a longitudinal direction, a lead-propelling mechanism, a lead reservoir, an eraser-propelling mechanism having a helical cam, and a side button;

preventing the side button from rotating about the longitudinal direction relative to the barrel;

inserting the lead-propelling mechanism into the barrel and preventing the lead-propelling mechanism from rotating about the longitudinal direction relative to the side button by utilizing a system for preventing rotating including a plurality of ribs including beveled longitudinal ends;

assembling the eraser-propelling mechanism and the lead reservoir together and preventing the eraser-propelling mechanism from rotating about the longitudinal direction relative to the lead reservoir; and inserting the lead reservoir and the eraser-propelling mechanism into the barrel and preventing the lead reservoir from rotating about the longitudinal direction relative to the lead-propelling mechanism.

12. A method according to claim 11, wherein the side button comprises an actuator portion and an annular ring connected together by a stem presenting an axis, wherein the barrel includes a slot extending in the longitudinal direction, and wherein the annular ring of the side button is inserted into the slot of the barrel and the side button is rotated through 90° about the axis of the stem, the side button being prevented from rotating about the longitudinal direction by cooperation between the stem and the slot.

13. A method according to claim 11, wherein the lead-propelling mechanism, the lead reservoir, and the eraser-propelling mechanism are coupled together longitudinally.

* * * * *